United States Patent [19]

Wilson

[11] 4,215,499

[45] Aug. 5, 1980

[54] COLLECTOR'S DEVICE

[76] Inventor: Harlan R. Wilson, P.O. Box 53025, Oklahoma City, Okla. 73105

[21] Appl. No.: 922,833

[22] Filed: Jul. 10, 1978

[51] Int. Cl.[2] ..... G09F 1/10

[52] U.S. Cl. ..... 40/158 R; 281/31; 206/461; 206/45.34

[58] Field of Search ..... 40/158 R, 159; 283/53; 206/461; 281/31

[56] References Cited

U.S. PATENT DOCUMENTS

| | | | |
|---|---|---|---|
| 271,765 | 2/1883 | Augir | 40/158 R |
| 356,454 | 1/1887 | Dammon | 40/158 R |
| 2,283,026 | 5/1942 | Yates | 40/158 R X |
| 2,598,755 | 6/1952 | Birch | 40/158 R |
| 3,307,281 | 3/1967 | Mateo | 283/53 X |

FOREIGN PATENT DOCUMENTS

| | | | |
|---|---|---|---|
| 1364348 | 5/1964 | France | 40/584 |

*Primary Examiner*—Louis G. Mancene
*Assistant Examiner*—Wenceslao J. Contreras
*Attorney, Agent, or Firm*—Robert M. Hessin

[57] ABSTRACT

A device for use by hobbyist collectors for assembling and saving for display memorabilia relating to selected persons, places or things. The device consists of a recording page in the form of an attested certificate for use by the collector in identifying the particular event, and the first side of the page includes in combination therewith a transparent box for containing selected matter relating to the particular event certificate. In addition, the reverse side of the certificate page includes a transparent plastic retaining cover for securing selected photographs related to the particular event. A plurality of such pages may, of course, then be retained in an album enclosure for permanent storage, or selected certificate pages may be framed for wall display or the like.

2 Claims, 5 Drawing Figures

COLLECTOR'S DEVICE

BACKGROUND OF THE INVENTION

1. Field of the Invention

The invention relates generally to collection storage devices and, more particularly, but not by way of limitation, it relates to an improved combination device including a recording page, storage box and photo display structure.

2. Description of the Prior Art

The prior art includes numerous types of collector's albums and other multi-page bound booklets of the type directed to collection and saving of memorabilia and souvenirs from designated events or places. However, Applicant is aware of no prior teaching which includes the combination of a collector's album page having photographic retention and display capability as well as a small transparent storage enclosure for retaining substance relative to the particular event or place.

SUMMARY OF THE INVENTION

The present invention relates to a hobbyist collector's device having a combination of attributes in that there is a page having a first side of particular decorative quality for recording time, place and event, and attestation of the collector, while the reverse side of the certificate page includes a foldable transparent plastic leaf of the removable adherence type for retaining pertinent photographs relating to the event. A small transparent plastic enclosure is then utilized in combination to be readily placed on the certificate page with contents of substance also identifiable with the event. The completed collector's certificate page may then be retained in a suitable album or it may be placed in frame for wall display or the like.

Therefore, it is an object of the present invention to provide an improved collector's device that enables saving and display of a greater amount of representation, specimens, and other pertinent data per unit space.

It is also an object of the invention to provide a collector's certificate page capable of retaining a wider variety of materials relating to a specified event or place.

Finally, it is an object of the present invention to provide a decorative form of collector's certificate page having specimen enclosure in combination therewith that may be readily retained in either a collector's album or in framed display.

Other objects and advantages of the invention will be evident from the following detailed description when read in conjunction with the accompanying drawing which illustrates the invention.

DETAILED DESCRIPTION OF THE PREFERRED EMBODIMENT

Figure 1:
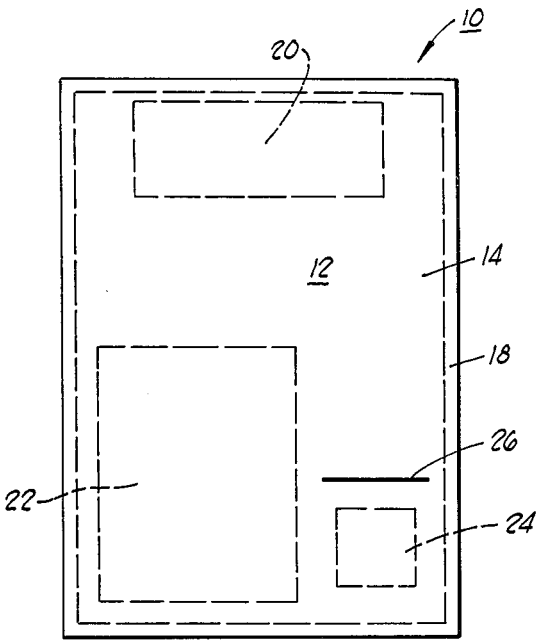
FIG. 1 is a schematic representation of a collector's certificate page as constructed in accordance with the present invention.

Referring now to FIG. 1, a collector's certificate page 10 consists of a conventional paper page 12 that is preferably constructed from higher quality paper having high rag content. The certificate page 10 consists of a first side 14 and a reverse side 16 (FIG. 2), and it is intended that the first side 14 be decoratively printed in a manner to convey official writing. Therefore, it is presently preferred that first page side 14 be outlined around the peripheral border 18 by filigree printing of official nature. An upper block space 20 is intended to carry an emblazon and page title relating to a selected category or collector's endeavor while a lower block space 22 is reserved for the securing of a selected photograph or other pertinent paper that particularly relates to the subject matter of the collector's certificate page 10. A space 24 at the lower right hand corner is then reserved for receiving a specimen enclosure box, as will be further described below. The remainder of certificate page 10 may then be utilized for recordation of the collector's name, identification of the specimen and where it was gathered, and the date of visit or recordation. Thereafter, the collector's statement may be closed with an attestation paragraph over a collector's signature line 26.

Figure 2:
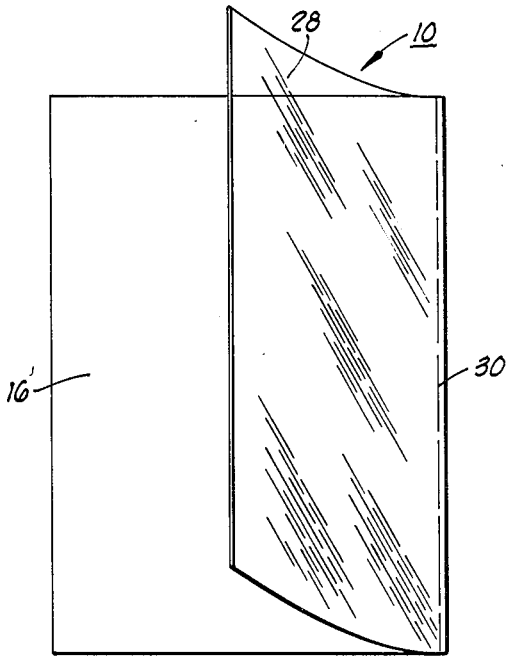
FIG. 2 is a plan view of the reverse side of the collector's certificate page of FIG. 1.

As shown in FIG. 2, the reverse side 16 of certificate page 10 includes a foldable transparent plastic cover 28 as secured along one edge 30 by suitable bonding thereby enabling the plastic cover 28 to be removably positioned over selected photographs or other written matter such as menus, programs and the like to retain such matters in association with the particular event recorded on the collector's certificate page 10. The plastic cover 28 may be any form of transparent plastic panel; however, it is preferred that it be the thin plastic film of the removable adherence type as is presently commercially available for such applications.

Figure 3:
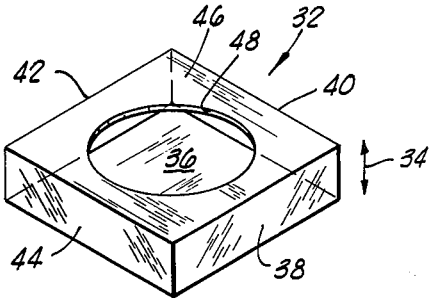
FIG. 3 is a perspective view of a memorabilia specimen collector's box constructed in accordance with the present invention.

FIG. 3 illustrates a preferred form of enclosure box 32 adapted for retention of specimen materials in permanent affixure at blank 24 of certificate page 10 (FIG. 1). The enclosure box 32 may be unitarily formed of transparent plastic by conventional molding techniques, and the controlling factor is that it have a relatively thin profile or short dimension 34. Thus, the box 32 includes a front face 36, and equal area of lateral sides 38, 40, 42 and 44, and a rear panel 46 having a centrally disposed access hole 48 formed therein. The enclosure box 32 is readily moldable using conventional plastics forming techniques and materials, e.g., polyvinyl chloride, ABM, or other of the basic polymer resins.

Figure 4:
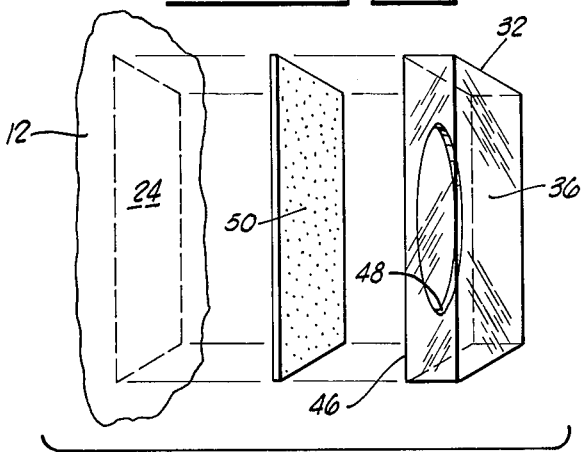
FIG. 4 is an exploded view in perspective of the enclosure box as it is secured to the certificate page.

FIG. 4 illustrates the manner in which enclosure box 32, after receiving a selected specimen material or item, may be secured at space 24 of first side 12 of certificate page 10. Thus, a square of double-adhesive plastic tape 50 is used to secure the rear panel 46 of enclosure box 32 over the space 24 of first side 12 while at the same time serving to seal the access opening 48 to retain the selected specimen within box 32. Commercially available double-adhesive plastic tape may be utilized, and a plurality of specimen boxes 32 as well as a plurality of tape squares 50 having adhesive protective fabric on each side may be supplied to the collector for his selective use with the collector's certificate pages.

It is contemplated that one side of the adhesive protective fabric on plastic tape 50 will carry printed spaces for notation of date, location, etc. relating to the particular specimen. Thus, a touring hobbyist may collect speciment memorabilia as desired, noting each for identification, and at some later time he may then construct a number of album pages from the collected material.

Figure 5:
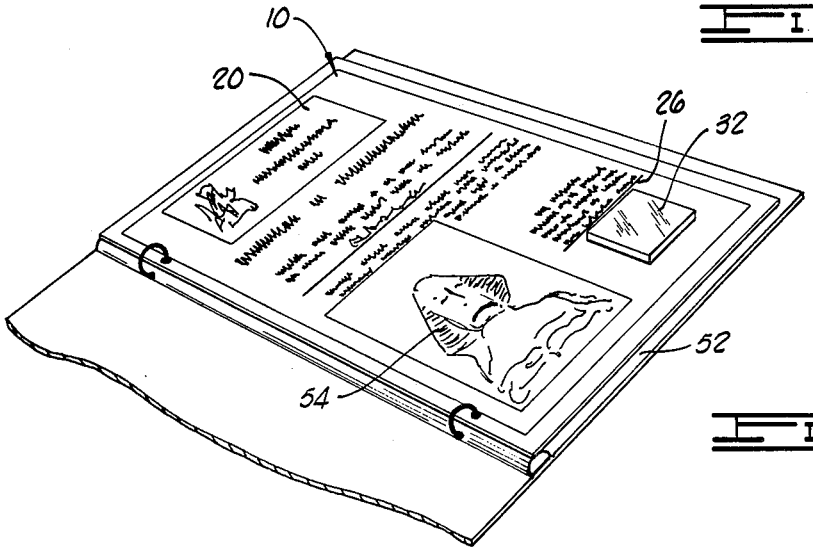
FIG. 5 is a perspective view of an album containing a plurality of such collector's certificate pages including specimen boxes affixed thereon.

FIG. 5 then illustrates an album 52 as it contains a plurality of such collector's certificate pages 10 in completed form. For example, in the particular page 10 shown in FIG. 5, the block space 20 may bear a suitable logo or emblazon coupled with the bold letters "THE WORLD TRAVELER'S CLUB". Immediately thereunder, in bold script lettering, it states "Certificate of Ownership" while in small print thereunder it states "Be it known that this certificate witnesseth that ___(Name)___ is the proud owner of one square inch of sand taken from The Base of the Great Sphinx in Egypt and that said specimen is affixed hereto and made a part of this document for any and all to see this third day of February, 1976." Thereafter, the collector may place his signature under attestation on line 26. The enclosure box 32 does indeed then contain sand as gathered at the base of the sphinx in accordance with the recordation, and a particularly representative photograph 54 may be secured in the photo reservation block 22 as shown in FIG. 1. The reverse side of certificate page 10 will, of course, contain certain additional pertinent photographs as retained by the plastic overlay panel 28 (FIG. 2). It is also contemplated that additional commercially available photo display pages similar to the reverse side 16 be included with the collector's sheet of materials so that he may place as many pages of photographs as desired with each collector's certificate page 10.

The hobbyist may also use additional page materials of his own selection in completing his album presentation. For example, it is contemplated to include pages of heavy kraft paper for receiving mounting of selected post cards that are representative of a particular place or event. Then, specimen materials relating to the place or event may be mounted in association by means of enclosure boxes 32. The back side of such pages may also be utilized for recording of certain notes that relate.

While each of the collector's certificate pages 10 may be similarly decorated with filigree and general printing and outline as to certificate of ownership, it is presently contemplated that they be identifiable with any of numerous categories. For example, Certificate of Ownership pages may bear selected emblazons and title in the block space 20 (FIG. 1) to identify with:

(1) THE ORDER OF HISTORIC TRAVELERS;
(2) THE SCENIC TRAVELER'S SOCIETY;
(3) THE ORDER OF CELEBRITY SEEKERS;
(4) A PERSONAL SOUVENIR FROM TIMES REMEMBERED; etc.

The foregoing discloses a unique hobbyist collector's device which enables the storage and display of not only pertinent photographs and recordation relating to a particular event or place but also the storage of a representative specimen such as sand, soil, souvenir momento, etc. Such collector devices and retention albums or frame display devices may be readily supplied in kit form to the collector in many of various collector categories as he might desire. Thus, the present invention enables not only a collector's device for complete saving and storage of event-related materials, but its decorative effects lend readily to wall display if so desired.

Changes may be made in the combination and arrangement of elements as heretofore set forth in the specification and shown in the drawing; it being understood that changes may be made in the embodiments disclosed without departing from the spirit and scope of the invention as defined in the following claims.

What is claimed is:

1. A device for collecting and display of memorabilia, comprising:

a recording page having first and reverse sides, said first side receiving printed entry of time, place, event and particular relevant data, said first side also including a designated area for receiving addendum matter in affixure thereto;

a transparent, generally thin, plastic enclosure that is unitarily formed and having at least two sides parallel, and having an access hole formed generally centrally on one parallel side for receiving memorabilia matter;

tape means of similar area to said one parallel side and having adhesive on each side thereof, for securing said one parallel side to said recording page designated area while sealing said enclosure; and plastic film of the attractive adherence type secured to one edge of the reverse side of said recording page and operable to removably retain photographs and other relevant documentation.

2. A device as set forth in claim 1 which further comprises:

a plurality of said recording pages having transparent enclosures and means for securing; and album means having rigid front and rear cover and means for detachably retaining said plurality of said recording pages.

* * * * *